United States Patent [19]

Motegi et al.

[11] 4,326,545

[45] Apr. 27, 1982

[54] CURLING IRON

[75] Inventors: Akio Motegi, Kitamoto; Takao Saitoh, Fukiage, both of Japan

[73] Assignee: Sanyei Corporation, Japan

[21] Appl. No.: 59,528

[22] Filed: Jul. 23, 1979

[30] Foreign Application Priority Data

Feb. 22, 1979 [JP] Japan ..... 54-022161

[51] Int. Cl.[3] ..... A45D 1/02

[52] U.S. Cl. ..... 132/33 R; 219/225

[58] Field of Search ..... 132/9, 33 R, 39, 36 R, 132/37 R, 32 R; 219/222–226; 15/202

[56] References Cited

U.S. PATENT DOCUMENTS

| | | | |
|---|---|---|---|
| 1,671,334 | 5/1928 | White | 15/202 |
| 3,766,930 | 10/1973 | Madsen et al. | 219/222 |
| 3,859,497 | 1/1975 | Monair | 219/225 |
| 3,922,521 | 11/1975 | Viegut et al. | 219/222 |
| 3,934,114 | 1/1976 | Godel et al. | 132/32 R |
| 3,935,423 | 1/1976 | Pucci | 219/225 |
| 3,955,064 | 5/1976 | Demetrio et al. | 219/225 |
| 3,990,460 | 11/1976 | Shalvoy | 132/9 |
| 4,029,110 | 6/1977 | Hyland | 132/9 |
| 4,040,696 | 8/1977 | Wada et al. | 219/225 |
| 4,097,718 | 6/1978 | Weise | 219/225 |
| 4,163,143 | 7/1979 | Federico et al. | 219/225 |

FOREIGN PATENT DOCUMENTS

| | | | |
|---|---|---|---|
| 1548540 | 7/1979 | Fed. Rep. of Germany | 219/222 |
| 2302061 | 10/1976 | France | 132/33 R |
| 1022388 | 3/1966 | United Kingdom | 132/33 R |

*Primary Examiner*—Paul J. Hirsch

*Attorney, Agent, or Firm*—Ostrolenk, Faber, Gerb & Soffen

[57] ABSTRACT

The disclosure concerns a hair curling iron having a heatable cylinder about which the hair is wound, and the heatable cylinder having holes through it, through which steam may be emitted. A heating element is positioned inside the heat cylinder for heating the cylinder. A water wetted wick is shiftable into engagement with the heating means for generating steam to be emitted through the holes in the heat cylinder. Longitudinally extending rows of radially outwardly extending protrusions are annularly arrayed around and are detachably connected directly to the heat cylinder for protecting a user against inadvertent contact with the heated cylinder surface. An electric terminal arrangement in the curling iron permits rotation of the curling iron to wind the hair on the heat cylinder without twisting the electric power cord.

11 Claims, 2 Drawing Figures

A
A

CURLING IRON

BACKGROUND OF THE INVENTION

The present invention relates to a curling iron, and particularly to an electrically heated curling iron which both heats hair wound upon the curling iron by contact of the hair with a heated surface and which optionally ejects steam into the hair wound upon the curling iron.

DESCRIPTION OF THE PRIOR ART

Heated curling irons and steam or vapor generating curling irons are quite old, as shown in U.S. Pat. Nos. 684,804 and 1,694,672. The application of heat to hair wound upon a curling iron while steam or vapor is being generated in the curling iron and is being delivered from within the curling iron to the hair is also known, as shown in U.S. Pat. No. 3,766,930 for a hair curler and U.S. Pat. Nos. 3,934,114 and 4,029,110 for a curling iron.

With all heatable curling irons, or the like, there is a danger that when the user's hair is wound up on the curling iron, the heated surface of the curling iron might contact the user's scalp. Furthermore, in normal handling of the curling iron during winding of the hair, the user's fingers could contact the heated surface of the curling iron. Heretofore, where a heated surface has been provided on which the user's hair is wound, there has not been adequate protection against the user being burned by the heated surface. For example, the comb shown in FIG. 8 of U.S. Pat. No. 4,029,110 does not provide protection for the user against contacting the heating surface where the comb is not present.

One additional problem experienced with curling irons is that they typically attached to an electric cord which should preferably not be twisted during use of the curling iron. However, to wind hair on a curling iron, it is necessary to rotate the curling iron. Thus, unless the electric cord is connected in an unusual manner with the curling iron, the cord will be twisted as the curling iron is rotated.

SUMMARY OF THE INVENTION

It is accordingly the primary object of the present invention to provide an improved curling iron with safety features.

It is another object of the present invention to provide a curling iron having a heated surface that contacts the user's hair, but which protects the user's skin against contacting the heated surface.

It is another object of the present invention to provide such a curling iron which is capable of heating the user's hair by direct contact and which is additionally capable of delivering steam vapor to the hair wound up on the curling iron.

It is a further object of the invention to enable the curling iron to be rotated in use without correspondingly twisting the electric cord supplying electric power to the curling iron.

It is yet another object of the invention to provide such a curling iron which enables the generation of steam to be rapid and only while the user needs it.

According to the invention, a curling iron is provided, which is comprised of a manually graspable handle and a heat cylinder attached to the handle. The heat cylinder contains heat generating means. The heat cylinder is heat conductive and transmissive. The surface of the cylinder is adapted to receive and support arrays of protrusions, like comb teeth, which are annularly arrayed around the entire heat cylinder and which project radially outwardly therefrom. The protrusions are positioned and spaced so as to prevent the user from touching the surface of the heated cylinder. The steam generated within the heat cylinder passes externally of the cylinder through holes passing through the cylinder wall.

In the preferred embodiment, the protrusions are arranged in a number of rows extending over the surface of the heat cylinder. The rows preferably extend longitudinally along the heat cylinder. The individual rows of the protrusions can be removed or inserted to the heating cylinder by an appropriate connection therebetween, such as a dovetail groove type connection between each row of protrusions and the cylinder. The steam holes of the cylinder are disposed beneath the support band for a row of protrusions and the row of protrusions is so positioned that holes through the support band for the row are aligned with holes through the heat cylinder, so that steam exiting from the heat cylinder is delivered between adjacent protrusions.

The heating means within the heat cylinder is adapted to be contacted by a water supply means, thereby to generate steam. The water supply means is movable on and off the heating means, thereby to selectively generate or halt the generation of steam as desired.

Other object and features of the present invention will become apparent from the following description of the accompanying drawings.

DESCRIPTION OF A PREFERRED EMBODIMENT

Figures 1, 2:
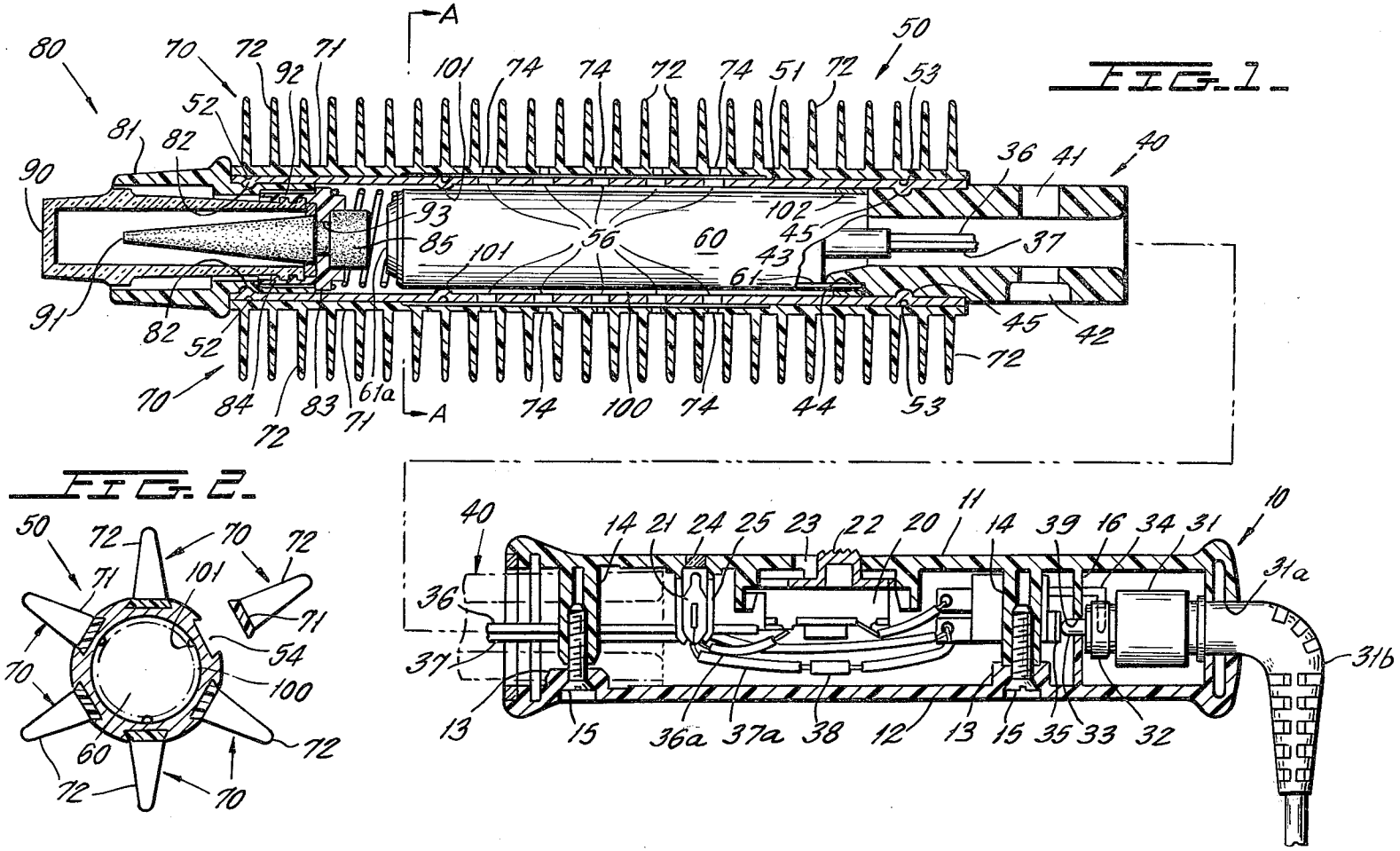
FIG. 1 is a cross-sectional view through a hair curling iron according to the present invention.
FIG. 2 is a cross-sectional view along the line a—a in FIG. 1.

A curling iron according to the present invention is shown in the drawings. The curling iron has a manually graspable, plastic handle 10, which is comprised of an upper housing member 11 and a lower housing member 12. Two longitudinally spaced apart bushings 13 are defined inside and project up from the lower housing member 12 for receiving the heads of the attachment screws 15. Projecting inwardly from the upper housing member and extending down toward the bushing 13 are the hollow, elongated bushings 14, which receive the shafts of the screws 15 that are tightened into the bushings 13. In this way, the upper and lower housing members 11,12 are joined to form a single body.

Within the handle 10, there is affixed a conventional, manually operable on-off switch 20, which is in circuit with the electrically energized heating means 60 of the curling iron. The switch 20 is operated by a switching knob 22 that projects above the upper housing 11 and is guided for motion along a guide strip 23.

A small indicator lamp 21 may also be connected in circuit with the switch 20 for indicating whether the heating means of the curling iron is on or off.

The lamp 21 is supported in a support holder 25 that extends inwardly from the upper housing member 11. A window 24 is provided in the upper housing member above the lamp 21.

A plug 31 is supported at the rear end of the handle 10 and the rear (right hand) end of the plug is journaled in the opening 31*a* at the rear end of the handle 10. An electric power cord 31*b* communicates into the plug 31. The journaling of the plug 31 enables the handle 10 of the curling iron to be rotated around its axis in use, when the hair is being wound on the curling iron, without correspondingly twisting the electric power cord 31*b*.

The plug 31 has an annular terminal element 32 on the inward or forward end thereof and wrapped about the periphery thereof, so that electric contact with the mechanism of the curling iron may be maintained as the handle 10 is rotated. A second terminal element post 33 is at the forward tip of the plug 31 and extends axially forward therefrom. The post 33 is journaled to rotate in an opening 39 in the support wall 16 which is defined on and extends in from one or both of the housing members 11, 12. The plug is supported in position at both journal openings 31*a*, 39.

A terminal element 34 in the handle 10 is normally urged into continuous engagement and electric contact with the annular terminal element 32. A terminal element post 35 is in continuous engagement and electric contact with the terminal element 33. The terminal elements 34,35 rotate with the handle 10, while the terminal elements 32,33 do not rotate. The terminal element 34 is electrically connected to the lead wire 36 through the switch 20. A lead wire 37 is electrically connected to the other terminal element 35. The lead wires 36, 37, in turn, communicate with the electrical heating means 60. The terminal element 34 is additionally connected to the lamp 21 through a lead wire 36*a* that also passes through the switch 20. The terminal element 35 is connected to the other terminal element of the lamp 21 through a lead wire 27*a* and through a resistor 38. This electric connection of the lamp 21 causes the lamp 21 to be illuminated when the switch 20 is operated to electrically connect the electric heating means 60.

The opening into the front terminal part of the handle 10 receives and supports a separate connecting cylinder 40. The outer periphery of the cylinder 40 toward the forward end thereof projects outwardly. The below described brush tube 50 is connected to the connecting cylinder 40 by the connecting cylinder 40 being plugged into the brush tube 50.

Opposite, aligned holes 41 and 42 are defined toward the rear end of the connecting cylinder 40. The forward ones of the screw bushings 13 and 14 of the handle 10 are respectively inserted into the holes 42 and 41 as the separate housing members 11 and 12 are being assembled together, and this secures the cylinder 40 to the handle 10.

The brush tube 50 is comprised of a hollow metal heat cylinder 51, which has a high level of heat conductivity. The connecting cylinder 40 is inserted into the rear end of the brush cylinder 50 until further insertion is halted by the fitting of the protruding parts 53 on the interior of the rear end portion of the cylinder 51 into cooperatingly positioned and shaped small holes 45 that are provided around the connecting tube 40 for receiving the protrusions 53. A pressing part 43 at the forward tip of the tube 40 is inserted into the rear end of the below described cylindrical body 61 of the heating means 60. A layer of packing material 44 is positioned between the pressing part 43 and the body 61, creating a seal.

The metal heat cylinder 51 is relatively thick walled and has a plurality of dovetail shaped grooves 54 defined therein at regularly annularly spaced apart positions. Each groove 54 is for removably receiving a respective below described brush piece 70. In the cylinder 51, along each groove 54, a respective series of aligned holes 56 extend through the cylinder 51 for permitting outlet of steam to the peripheral surface of the cylinder 51.

A plurality of toothed, brush like pieces 70 are arrayed annularly around the metal cylinder 51 and each is separably affixed to the cylinder 51 in a respective groove 54. Each brush piece 70 is an integral unit comprised of an elongated band shaped base 71, which is dovetail profiled in cross-section to be axially slipped into and thereafter securely held against being pulled out of a dovetail shaped receiving opening 54 therefor. The base 71 carries a series of outwardly projecting, regularly spaced protrusions or teeth 72 which project radially outwardly of the metal cylinder 51.

At regular intervals along the length of the base 71, between two protrusions 72, a series of holes 56 are defined which, when the brush piece 70 is fully inserted in its respective groove 54, are aligned with and are over the respective holes 56 in the metal cylinder 51, thereby providing for ejection of steam from inside the cylinder 51.

Each brush piece 70 is an integral unit comprised of a synthetic resin material, such as a nylon resin, which can withstand the heat generated by the electrical heating means 60 and therefore the heat of the cylinder 51 without deterioration in strength or quality over time and which also has the requisite degree of elasticity. The brush pieces and particularly the protrusions 72 thereof should be adequately rigid to maintain their straight upright orientation during normal use of the curling iron.

Electric heating means 60 are accomodated inside the brush cylinder 50. The electric heating means 60 includes a cylindrical body 61 with an outer diameter quite close to the inner diameter of the heat cylinder 51. The body 61 has a flattened front (left hand) end surface 61*a* which is sealed and is heated for generating steam, as described below. There is a heating element within the cylindrical body 61, which is of the conventional electric resistance type, and it need not be further described.

The cylindrical body 61 is supported in the cylinder 51 toward the forward end of the cylindrical body 61 by the annular array of protrusions 101 which are provided on the interior surface of the metal cylinder. The rearward end of the cylindrical body 61 is supported in the metal cylinder 51 by the layer of packing material 102. The cylindrical body 61 is spaced from the inner wall of the cylinder 51 to define a clear annular passageway 100 for the passage of steam inside and along the cylinder 51 up to, but not past, the packing layer 102.

Water supply means 80 are provided at the front (left-hand) end of the brush tube 50. The water supply means 80 comprises a sleeve 81 that is longitudinally shiftable with respect to the cylinder 51. A series of small holes 82 are provided in the sleeve 81 for stopping the insertion of the sleeve 81 into the metal cylinder 51. Cooperating protrusions 52 on the interior of the cylinder body 51 are received in the holes 82, thereby stopping further insertion of the sleeve 81.

A sliding piece 83 is positioned between the inserted end of the sleeve 81 and the surface 61*a* of the electrical heating means 60. The compressed compression spring 85 between the sliding piece 83 and the electrical heating means 60 normally urges the sliding piece 83 out of the cylinder 51. The sliding piece 83 carries a relatively large diameter wick or core of water absorbent material, which is comprised of felt, or the like. The core or wick 91 passes through a narrowed hole 93 in the sliding piece 83 and this halts shifting of the core or wick. The inward or rearwardly facing end of the core or wick 91 is normally spaced from the surface 61*a* of the electrical heating means 60. This assures that when the sliding piece is inserted into the cylindrical tube 51 against the opposition of the spring 85, proper insertion of the piece 83 is assured.

A spiral groove 84 is provided on an inner wall of the tip of the sliding piece 83. This enables the sliding piece 83 to be screwed onto the correspondingly spirally grooved exterior of the rear portion of the water container 90. The water container 90 is inserted in a freely rotatable manner into the sleeve 81 whereby it may be freely rotated with respect to the sleeve. The open rear (right hand) end of the water container 90 accommodates the large forwardly projecting end of the water absorbent core or wick 91. As noted above, the water container 90 can be screwed into the sliding piece 83 which caps it.

Upon rotation of the curling iron around its axis by a user grasping the handle 10, the hair to be curled is held by the protrusions 72 and the hair is wound tightly around the brush tube 50 and is in secure engagement with the metal cylinder 51. When the switch 20, 22 is operated on, the hair that has been wound on the brush tube 50 is heated by contact with the cylinder 51. Because the protrusions 72 are arrayed around the cylinder 50 and project radially therefrom, there is no danger that the metal cylinder 51 will directly contact the user's scalp and no danger that the user's hands will accidentally contact the metal cylinder. At the same time, the protrusions 72 permit the hair to contact the heated metal cylinder, for heating the hair.

The water container 90, which is filled with water, is installed on the brush tube 50. After hair has been wound onto the brush tube 50, the tip of the water container is pushed in, to the right in the drawing. This slides the sliding piece 83 to the right in opposition to the spring 85. Eventually, the tip of the water absorbent core or wick 91 contacts and presses upon the opposed end surface 61*a* of the electrical heating means 60. When such contact occurs, the water in the flexible core is squeezed out of the core and the released water is heated and vaporized into steam which quickly fills the interior of the metal cylinder 51 and particularly the annular space 100 around the cylinder 61. The steam is ejected from the space 100 through the openings 56 and the aligned openings 74 in the supports 71. To halt production of steam, the user simply halts the application of pressure upon the end of the water container 90. The spring 85 immediately returns the sliding piece 83 to the left and this moves the absorbent material or wick 91 off the heating means 60. This immediately terminates the generation of steam, whereby it is possible to produce and eject steam practically instantaneously only for the desired period of time.

In summary, therefore, the invention provides a safe curling iron, which is capable of applying direct heat to the hair and of simultaneously ejecting steam into the hair, if that is desired, while it protects the user's scalp and hands from direct contact with the heated surface of the curling iron. Furthermore, means are provided for enabling generation of the steam that is to be emitted from the curling iron for the precise period when steam is required. Additionally, the curling iron is connected to an electric cord, and the connection between the curling iron and the electric cord permits rotation of the curling iron without twisting of the electric cord.

Although the present invention has been described in connection with a preferred embodiment thereof, many variations and modifications will now become apparent to those skilled in the art. It is preferred, therefore, that the present invention be limited not by the specific disclosure herein, but only by the appended claims.

I claim:

1. A hair curling iron, comprising a heat conducting and transmitting cylinder; heating means in said heat cylinder for heating said heat cylinder; said heat cylinder being defined by an annular wall having a plurality of holes through it through which steam may pass;

steam producing means communicating into said heat cylinder for producing steam and for delivering steam into said heat cylinder for the steam to be emitted through said holes in said heat cylinder;

a plurality of heat non-conductive protrusions arrayed in a plurality of rows thereof said rows each extending longitudinally along said heat cylinder, and said rows being spaced apart annularly around said heat cylinder; said protrusions extending radially outwardly of said heat cylinder for enabling hair wound around said heat cylinder to be held against said heat cylinder and being so placed as to assist in preventing any undesired contact by the user of the curling iron with said heat cylinder;

each said row of protrusions comprises a supporting band and comprises a plurality of said protrusions spaced apart along and attached to said supporting band; means normally removably holding said supporting bands to said heat cylinder;

said holes in said heat cylinder are placed so as to be beneath said supporting bands; said supporting bands having holes therein for communicating with said holes in said heat cylinder to thereby provide exit pathways for steam from inside said heat cylinder through said holes in said heat cylinder and through said holes in said supporting bands.

2. The hair curling iron of claim 1, further comprising a passageway between said heating means in said heat cylinder and said heat cylinder for conduction of steam along said passageway to said holes in said heat cylinder.

3. The hair curling iron of either of claims 1 or 2, wherein said steam producing means comprises a wick movable into and out of contact with said heating means and comprises a reservoir communicating with said wick for supplying water thereto.

4. The hair curling iron of claim 1, further comprising: electric terminal means in said curling iron and connected with said heating means; an electric power cord connected with said terminal means; said terminal means being adapted to maintain continuous electric contact with said heating means as said curling iron is rotated around its axis during use.

5. The hair curling iron of either claims 1 or 4, further comprising: a graspable handle portion apart from said heat cylinder and being adapted for being attached to said heat cylinder for supporting said heat cylinder.

6. The hair curling iron of claim 1, wherein said supporting band holes are positioned to be aligned with said holes in said heat cylinder.

7. The hair curling iron of claim 6, wherein said holes in said supporting bands are located between said protrusions thereon.

8. A hair curling iron, comprising:

a heat conducting and transmitting cylinder; heating means in said heat cylinder for heating said heat cylinder; said heat cylinder being defined by an annular wall including steam passage means through it through which steam may pass;

steam producing means communicating into said heat cylinder for producing steam and for delivering steam into said heat cylinder for the steam to be emitted through said passage means of said heat cylinder;

a plurality of heat non-conductive protrusions arrayed in a plurality of rows thereof said rows each extending longitudinally along said heat cylinder, and said rows being spaced apart annularly around said heat cylinder; said protrusions extending radially outwardly of said heat cylinder for enabling hair wound around said heat cylinder to be held against said heat cylinder and said protrusions being so placed as to assist in preventing undesired contact by the user of the curling iron with said heat cylinder;

each said row of protrusions comprises a supporting band and comprises a plurality of said protrusions spaced apart along and attached to said supporting band; means normally removable holding said supporting bands to said heat cylinder;

said supporting bands having holes therein positioned to communicate with said passage means to thereby provide exit pathways for steam from inside said heat cylinder past said passage means and through said holes.

9. The hair curling iron of any of claims 1, 6 or 8, wherein said means for normally removably holding said bands to said heat cylinder comprises a respective dovetail shaped groove in said heat cylinder for each said row of protrusions, and each said supporting band also being dovetail shaped for being received in said dovetail shaped groove in said heat cylinder.

10. The hair curling iron of any of claims 1, 6 or 8, wherein said means for normally removably holding said bands to said heat cylinder comprises a dovetail connection between each said row of protrusions and said heat cylinder.

11. The hair curling iron of either of claims 1 or 8, wherein said holes in said supporting bands are located between said protrusions thereon.

* * * * *